US009157237B2

(12) United States Patent
Johnson

(10) Patent No.: US 9,157,237 B2
(45) Date of Patent: Oct. 13, 2015

(54) ROOF TILE CROWN SUPPORT

(71) Applicant: T&S Newco, LLC, Okeechobee, FL (US)

(72) Inventor: Terry R. Johnson, Okeechobee, FL (US)

(73) Assignee: T&S Newco, LLC, Okeechobee, FL (US)

( * ) Notice: Subject to any disclaimer, the term of this patent is extended or adjusted under 35 U.S.C. 154(b) by 0 days.

(21) Appl. No.: 14/141,212

(22) Filed: Dec. 26, 2013

(65) Prior Publication Data

US 2014/0174022 A1 Jun. 26, 2014

Related U.S. Application Data

(60) Provisional application No. 61/745,903, filed on Dec. 26, 2012.

(51) Int. Cl.

| | |
|---|---|
| ***E04H 12/28*** | (2006.01) |
| ***E04B 1/38*** | (2006.01) |
| ***F24F 7/02*** | (2006.01) |
| ***E04D 1/34*** | (2006.01) |
| ***E04D 12/00*** | (2006.01) |
| *E04D 1/06* | (2006.01) |
| *E04D 13/17* | (2006.01) |

(52) U.S. Cl.

CPC ..... *E04D 1/3402* (2013.01); *E04D 12/008* (2013.01); *E04D 1/06* (2013.01); *E04D 13/176* (2013.01)

(58) Field of Classification Search

CPC ... E04D 13/174; E04D 12/008; E04D 13/176; E04D 1/3402; E04D 1/06; E04D 3/30; F24F 7/02; Y10S 52/06

USPC ..... 52/198, 199; 454/365

See application file for complete search history.

(56) References Cited

U.S. PATENT DOCUMENTS

| | | | | | |
|---|---|---|---|---|---|
| 1,453,996 | A * | 5/1923 | Riddle | 52/376 |
| 4,558,637 | A * | 12/1985 | Mason | 454/365 |
| 4,788,801 | A * | 12/1988 | Jones | 52/57 |
| 5,167,579 | A | 12/1992 | Rotter | |
| 5,326,318 | A * | 7/1994 | Rotter | 454/365 |
| 5,609,006 | A * | 3/1997 | Boyer | 52/481.1 |
| 5,738,581 | A * | 4/1998 | Rickert et al. | 454/365 |
| 5,740,634 | A * | 4/1998 | Schade | 52/43 |
| 6,015,343 | A * | 1/2000 | Castillo et al. | 454/365 |
| 6,647,675 | B1 * | 11/2003 | Castellanos | 52/198 |
| 6,966,156 | B2 * | 11/2005 | Dixon | 52/199 |
| 6,993,883 | B2 * | 2/2006 | Belanger | 52/847 |
| 7,024,829 | B2 * | 4/2006 | Sharp et al. | 52/199 |
| 7,774,990 | B1 * | 8/2010 | Castellanos | 52/57 |
| 8,037,643 | B1 | 10/2011 | Anderson | |
| 8,083,576 | B2 * | 12/2011 | Rotter | 454/365 |
| 2002/0072324 | A1 * | 6/2002 | Strait | 454/365 |
| 2002/0187745 | A1 * | 12/2002 | Smith | 454/365 |

(Continued)

*Primary Examiner* — David R Dunn
*Assistant Examiner* — Omar Hijaz
(74) *Attorney, Agent, or Firm* — McHale & Slavin, P.A.

(57) ABSTRACT

A device for securing a roof tile crown or cap to a roof ridge or roof hip is described. The roof tile crown support can be easily and quickly secured to an existing roofing structure. The device contains a main body defined by a plurality of opposing side walls, a top wall, and a pair of leg plate support structures, attached or integrally formed to each of the opposing side walls. Within the interior region of the roof tile crown support, a support structure is secured therein. To aid in shipping, a plurality of like-shaped roof tile crown support units can be adapted to nest within other like shaped roof tile crown supports.

16 Claims, 13 Drawing Sheets

(56) References Cited

U.S. PATENT DOCUMENTS

2004/0000101 A1* 1/2004 Dixon ..... 52/43
2005/0126088 A1* 6/2005 Rotter ..... 52/198
2006/0070340 A1* 4/2006 Fanucci et al. ..... 52/729.1
2006/0223436 A1* 10/2006 Matyja ..... 454/365
2008/0318516 A1* 12/2008 Rotter ..... 454/365

* cited by examiner

ROOF TILE CROWN SUPPORT

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 61/745,903, filed Dec. 26, 2012, entitled "ROOF TILE CROWN SUPPORT". The contents of which the above application is incorporated by reference.

FIELD OF THE INVENTION

The present invention relates to roofing, and more particularly to a device for use in attaching a roof tile crown, or cap, to a ridge or hip portion of a roof structure.

BACKGROUND OF THE INVENTION

One of the single most important components of any building or home is the roof structure. The roof is designed to protect the interior section from a variety of environmental elements, such as the heat, cold, precipitation such as rain or snow, or from invasion of insects. Typical roof structures include roof coverings such as shingles or tiles. The shingles or tiles have dual purpose, providing decorative as well as protective functionality, preventing environmental factors from entering the interior of the building. Particularly for structures which include a ridge or hip, such as slanted roofs, protecting the ridge, as well as the roof hip, is vital to the roof structural integrity. A common method of protecting this area is through the use of ridge or hip coverings, such as roof tile crown or cap. Numerous devices and systems have been developed in an effort to provide such functionality.

DESCRIPTION OF THE PRIOR ART

U.S. Pat. No. 5,167,579 is directed to a roof venting system described as having a unique mat to cover the ridge slot. The mat is described as having unitary sheet construction of randomly aligned synthetic fibers which are opened and blended, randomly aligned into a web by airflow, joined by phenolic or latex binding agents and heat cured to produce an air-permeable varying mesh. The unitary mat provides the desirable physical properties such as tensile strength, resilience, ability to be transported in rolls and cut to length, ease of joining strips, long term durability in local ambient conditions, water and insect barrier, and low profile, without requiring sheets of dissimilar materials to be bonded together to provide such properties.

U.S. Pat. No. 5,326,318 is directed to an adjustable roof ridge ventilator for use with heavy roofing tiles. The ventilator is described as including a support member designed to straddle a roof ridge opening and support and space heavy roofing tiles above the roof surface. The support member is described as having a ridge tile anchoring portion which runs along its longitudinal axis. On each side of the ridge tile anchoring portion, a side wall portion having at least one vent opening is further described. The side walls and ridge tile anchoring portion form an open channel. The ventilator is further described as having an air-permeable vent material which is disposed in and along the channel. The lower portion of each side wall is formed outward to form a skirt portion for straddling the roof ridge.

U.S. Pat. No. 5,326,318 is directed to a ventilating device for ventilating through a ridge. The device is described as including a ridge member configured extending longitudinally along and beneath the ridge. The ridge member has a rigid part that includes two opposed panels and a number of cross pieces extending between the opposing panels. The ridge member also has passages extending from a lower part of the ridge member to an upper part of the ridge member. In a first embodiment, the cross pieces extend from the lower part to the upper part of the ridge member transverse to a longitudinal direction of the ridge member, and ventilating passages are formed in spaces between the two opposing panels and between the cross pieces.

U.S. Pat. No. 8,037,643 is directed to an apparatus and method for roof ridge construction. The apparatus is described as including ridge risers to securely retain an attachment block above sheathing portions at an elevation sufficient to permit air venting through the ridge. The ridge risers are described as having legs with one or more weakened regions (such as scores) that permit easy folding so that the legs can be attached to the sheathing and/or rafter portions. A set of attachment holes may be positioned below each of the weakened regions. The legs are joined to a cradle in which the attachment block rests. The attachment block is retained within the cradle via a mechanism such as fasteners, retention cleats, and retention assemblies with tabs designed to be driven into the attachment block. Roof covering elements, such as shingles, shakes, tiles, slate units, metal units, and synthetic ridge covering elements, are attached to the roofing block.

U.S. Patent Application Publication Number 2006/0223436 is directed to a system and method for improved tile roof hip and ridge vent. The system is described as including a single piece ridge vent for use with tile roofs comprising a generally rectangular piece of sheet metal folded to form an inverted U-shape comprising a top, a left side having a left flange and a right side having a right flange, wherein the left flange and the right flange provide a means for attaching the single piece ridge vent to a roof sheeting.

SUMMARY OF THE INVENTION

The present invention provides a device for securing a roof tile crown or cap to a roof ridge or roof hip. The roof tile crown support can be easily and quickly secured to an existing roofing structure. The roof tile crown support includes a main body defined by a plurality of opposing side walls, a top wall, and a pair of leg plate support structures attached to or integrally formed to each of the opposing side walls. Within the interior region of the roof tile crown support, a support structure is secured therein. To aid in shipping and on-site storage, a plurality of like-shaped roof tile crown support units can be adapted to nest within other like-shaped roof tile crown supports.

Accordingly, it is an objective of the present invention to provide a roof tile crown support structure.

It is a further objective of the present invention to provide a roof tile crown support structure adapted for easy shipping.

It is a still further objective of the present invention to provide a roof tile crown support structure adapted for minimizing the amount of space required for on-site storage.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
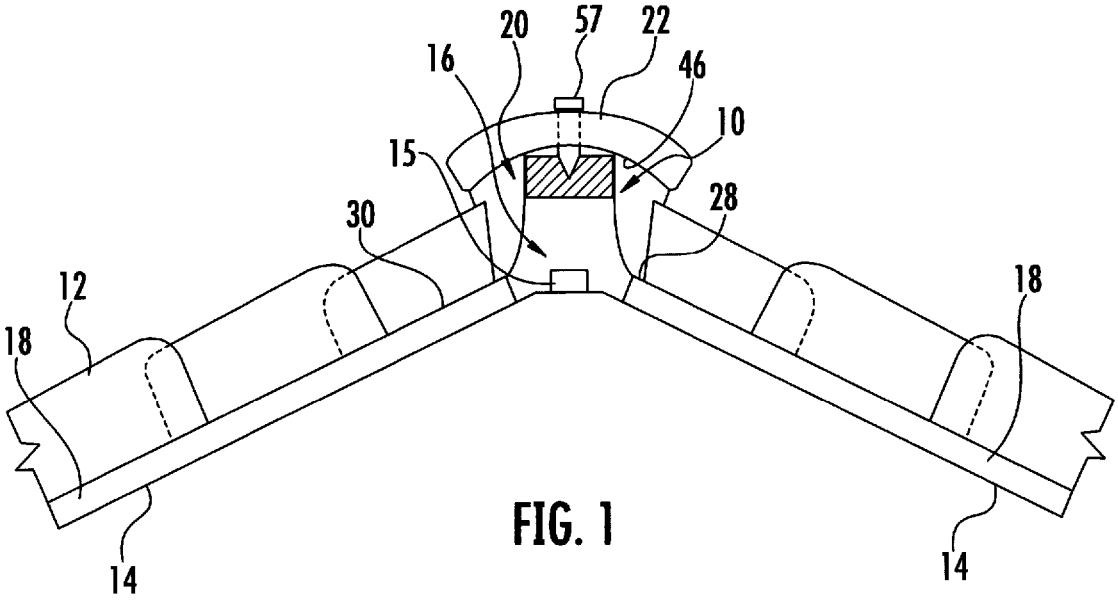
FIG. 1 is a cross sectional view of the roof tile crown support in accordance with the present invention inserted within a roof structure.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to FIG. 1, a roof tile crown support, referred to generally as 10, is shown as part of a roofing structure 12. The roofing structure is shown having two rafters 14 secured to a beam 15 to form a ridge or apex 16. Attached to the rafters 14 are sheathing panels 18. The sheathing panels 18 are positioned just short of the apex 16 to form an opening 20. Additional components may be applied to the roofing structure 12, such as the use of underlayment. While many roofs structures are constructed to contain an opening for use as a means for ventilation, the opening 20 need not be included for the present invention to function properly. The roof tile crown support 10 attaches to the roofing structure 12 through any known coupling mechanism, whether mechanical or not, which restricts relative motion between the roof tile crown support 10 and the roofing structure 12. To prevent external factors, such as rain or snow from entering the opening 20 or from damaging the rafters 14, a roof tile crown or ridge cap 22 is placed on top of the roof tile crown support 10.

Figure 2:
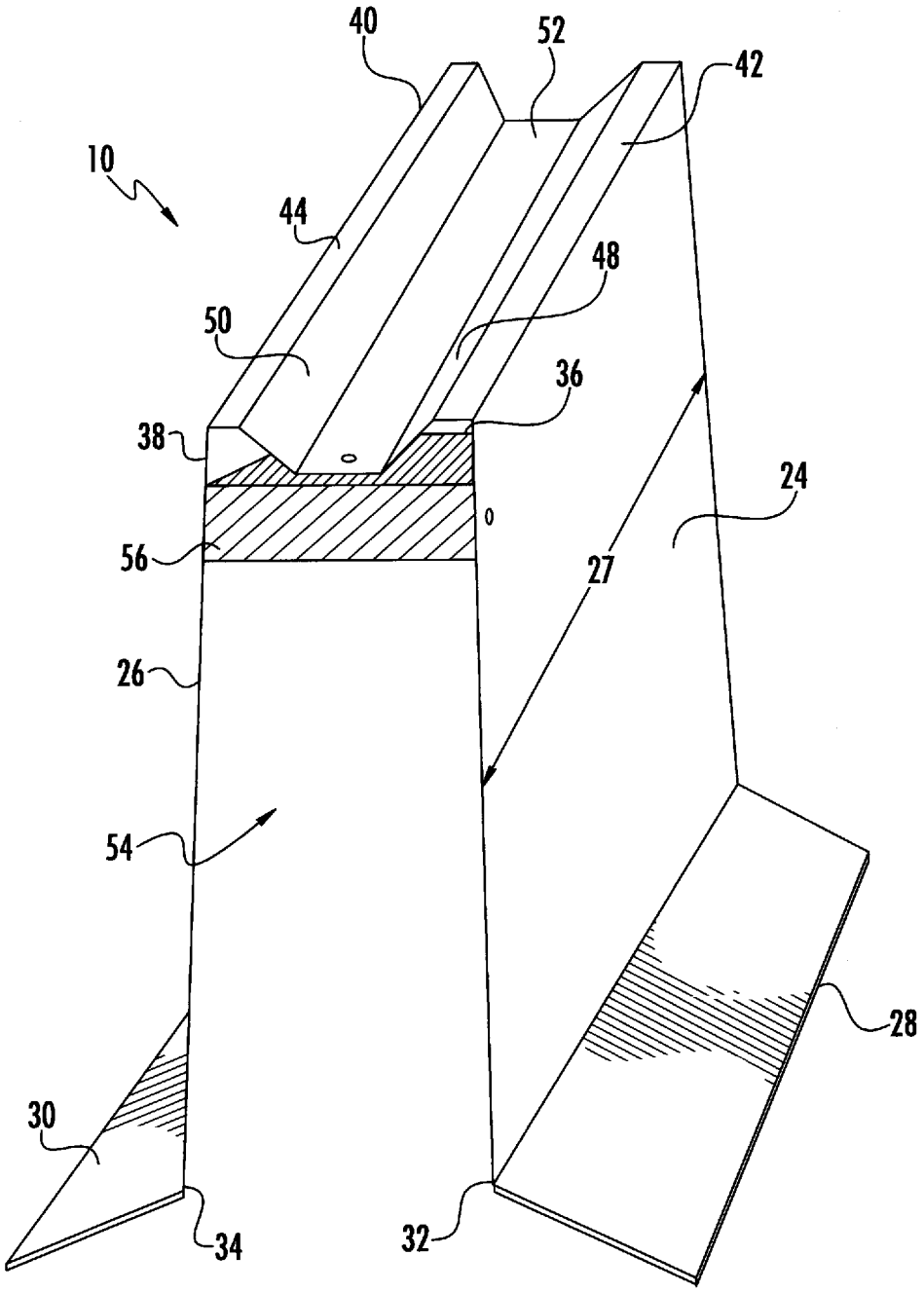
FIG. 2 is a perspective view of the roof tile crown support.

Referring to FIG. 2, a perspective view of an illustrative embodiment of the roof tile crown support 10 is shown. The roof tile crown support 10 is preferably constructed as a single unit and made of a metal or similar material. Alternatively, one or more parts may be made independently and fastened to existing components to form a working unit. The roof tile crown support structure 10 is designed to provide a support mechanism for ridge caps. Preferably, the roof tile crown support structure 10 is positioned at the apex of the roof. However, alternative positioning may be used. For example, the roof tile crown support structure 10 may be used to secure a cap over other areas where two sloping planes intersect, such as the hip portion of the roof.

The roof tile crown support structure 10 contains a plurality of opposing elongated side walls 24 and 26. As used herein, the use of the term "elongated" indicates that the each wall has a length 27, preferably the same or similar length that the roof tile crown support structure 10 secures or is attached thereto. As such, the roof tile crown support structure 10 can be placed along the roof and allow multiple tiles to be secured thereto. Each elongated side wall 24 and 26 contains a leg plate roof securing structure 28 and 30 positioned at or near the ends 32 or 34 of the side walls 24 and 26. Each leg plate securing structure 28 and 30 is constructed of a generally planar surface and is adapted to be secured to a portion of the roofing structure. As illustrated in FIG. 1, the leg plate securing structures 28 and 30 attach to the sheathing panels 18. To provide a secure fit, the leg plate securing structures 28 and 30 are connected to the side walls 24 and 26 at an angle. The roof tile crown support structure 10 may be prefabricated so that the leg plate roof securing structures 28 and 30 are arranged at a predetermined angle, $\alpha$, such as for example an obtuse angle, see FIG. 3, relative to the side walls 24 and 26. Alternatively, the roof tile crown support structure 10 may be made of a material that is malleable and or bendable so that the exact angle can be formed at the site of installation. In any case, it is desirable that the angle formed is the same as or generally corresponds to the pitch of the roof so that each leg plate support structure rests generally flat against the roofing structure it is secured thereto.

Formed or attached to an upper end 36 of the side wall 24 and an upper end 38 of the side wall 26 is a top wall 40. The top wall 40 is adapted to support a ridge cap or ridge crown, see indicator 22 on FIG. 1. The top wall is constructed having a plurality of longitudinally segmented surfaces, several of the surfaces aligned or having different orientations. The top wall 40 has a width equal to the distance between the opposing side walls 24 and 26 and has a length defined by the lengths of each of the side walls. The top wall 40 contains a plurality parallel and spaced apart surfaces which define roof tile crown or cap landings 42 and 44, illustrated here in as generally planar surfaces. Each roof tile crown or cap landing 42 and 44 is sized so as to provide a contact point with at least one portion of a roof tile crown or ridge cap, such as an inner surface 46 of the roof tile crown or ridge cap 22 shown in FIG. 1. A plurality of angled surfaces 48 and 50 diverge from the end of crown or cap landings 42 and 44 or are directed inwardly toward the center of the roof tile crown support 10, terminating in a planar bottom surface 52. Preferably, the surfaces 48 and 50 are angled to provide an obtuse angle relative to the planar surface 52, see $\beta$, FIG. 3. The planar surface 52 is preferably positioned below the roof tile crown or cap landings 42 and 44.

Inclusion of the top wall 40 provides a roof tile crown support 10 having an interior area 54 defined by the opposing side walls 24 and 26, and the top wall 40. Inserted within the interior area 54 is an insert spacer 56. The insert spacer 56, illustrated herein as a wood beam, is adapted to maintain the side walls 24 and 26 in predetermined position, preventing either side wall from inward movement. Accordingly, the spacer 56 preferably has a width equal to, or slightly less than the distance between the opposing walls 24 and 26 and a length that is equal to, or is slightly less than the length of the roof tile crown support 10 (defined by the length of each opposing wall 24 and 26). While the insert spacer 56 is illustrated as a wood beam, any suitable material known to one of skill in the art may be used.

Figure 3:
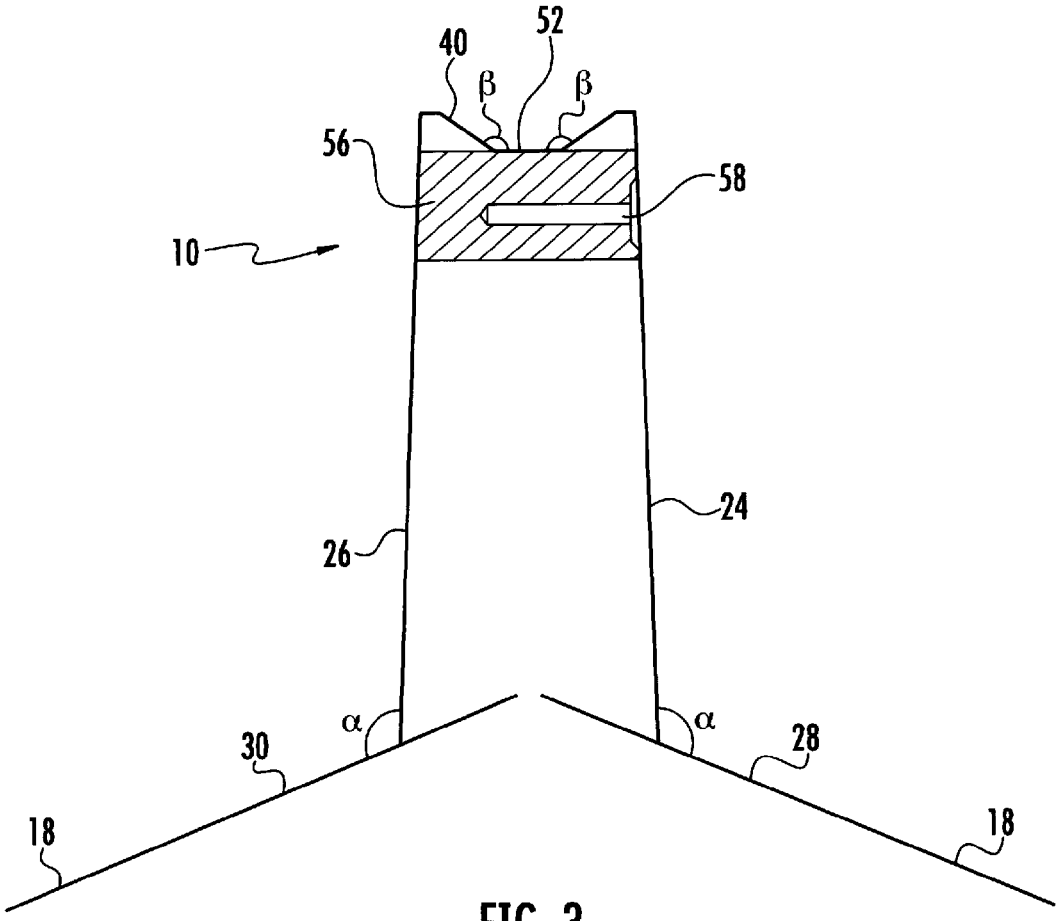
FIG. 3 is a front view of the roof tile crown support illustrated in FIG. 2 shown with a side positioned securing member inserted therein.
Figure 4:
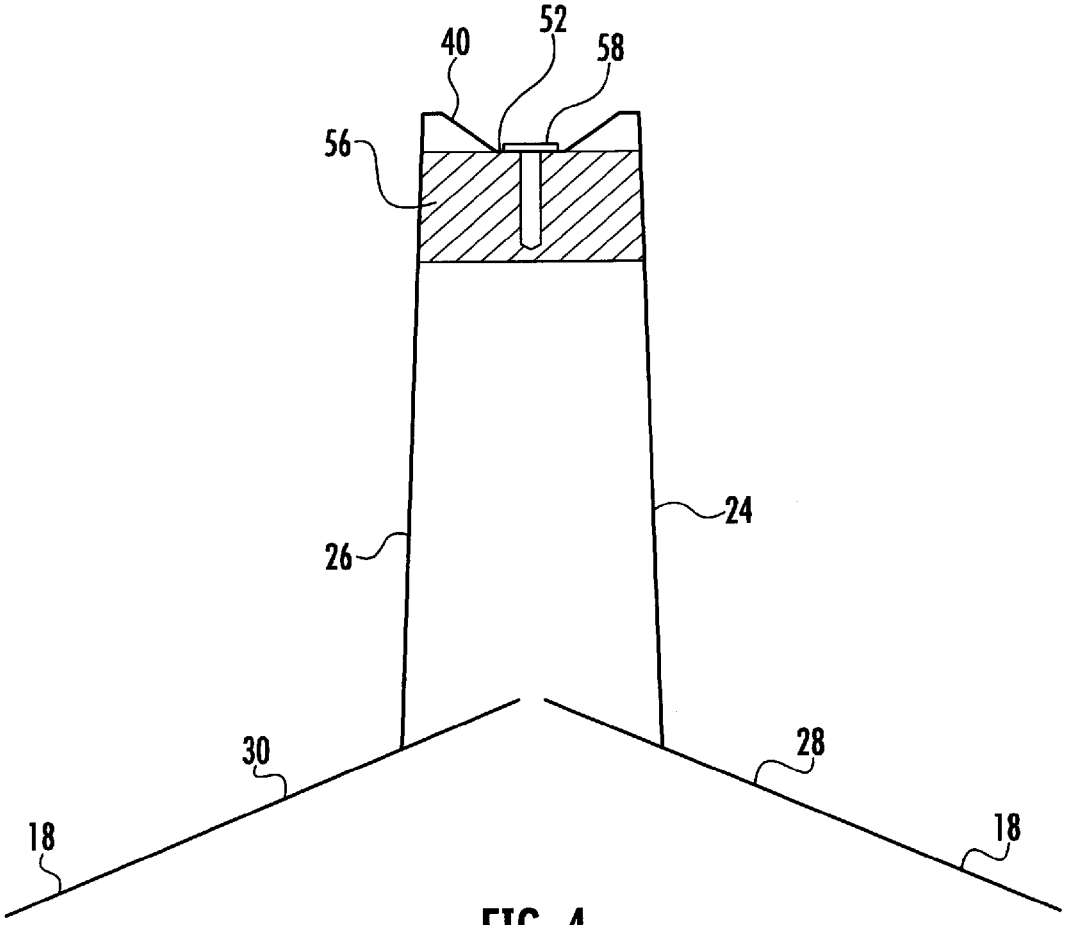
FIG. 4 is a front view of the roof tile crown support illustrated in FIG. 2 with a top positioned securing member inserted therein.

The insert spacer 56 is designed to be secured within the interior area 54. FIGS. 3 and 4 illustrate one mechanism in which the insert spacer 56 secures to the side walls 24 or 26 using a fastening member, such as a screw 58. As shown in FIG. 3, the screw 58 is inserted through side wall 24 and into the insert spacer 56. Preferably, a plurality of screws is inserted into both side walls 24 and 26 in an alternating arrangement. FIG. 4 illustrates the securing of the insert spacer 56 through the top wall 40. In this arrangement, the screw 58 is inserted through the planar surface 52 of the top wall 40 and into the insert spacer 56. Additionally, the insert spacer 56 may be used to secure the roof tile crown or ridge cap 22 is placed on top of the roof tile crown support 10 to the roof tile crown support 10 via a screw 57, see FIG. 1. As an illustrative example, the screw 57 is inserted into the roof tile crown or ridge cap 22, through the planar surface 52 and into the insert spacer 56.

Figure 5A:
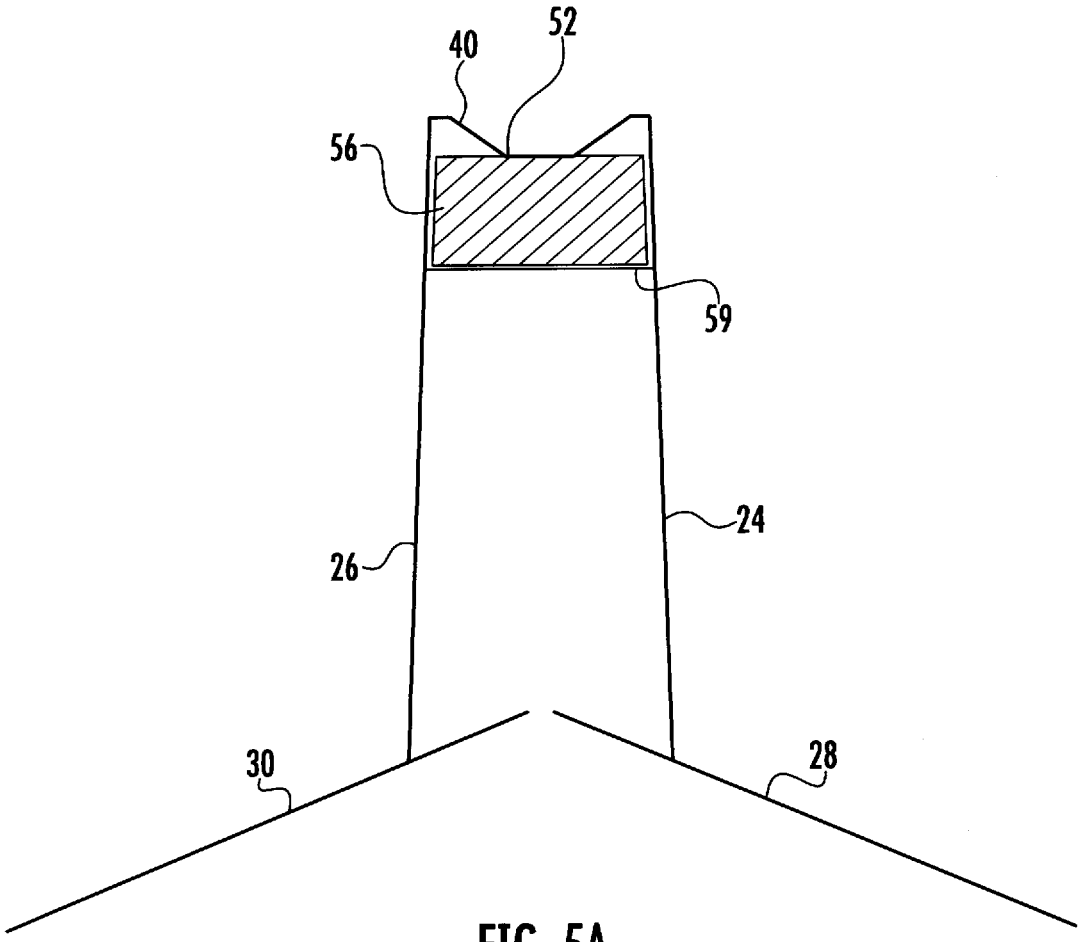
FIG. 5A illustrates an alternative embodiment of the roof tile crown support in accordance with the present invention.
Figure 5B:
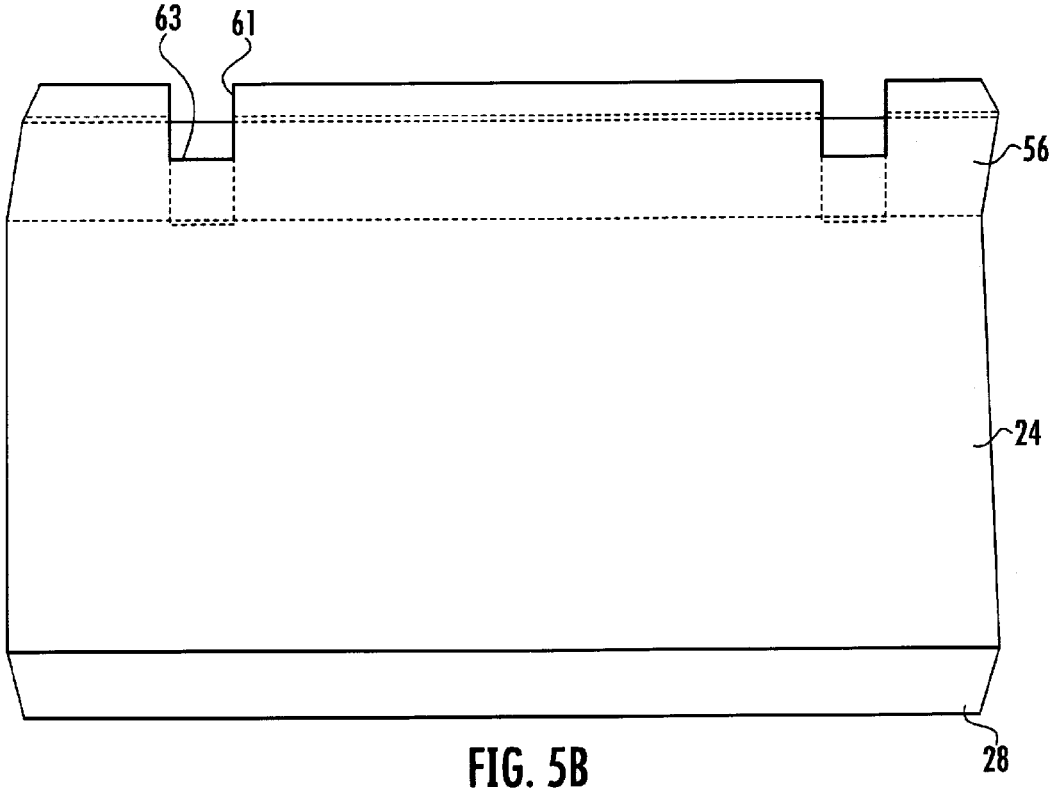
FIG. 5B is a side view of an alternative embodiment of the roof tile crown support show in FIG. 5A.
Figure 5C:
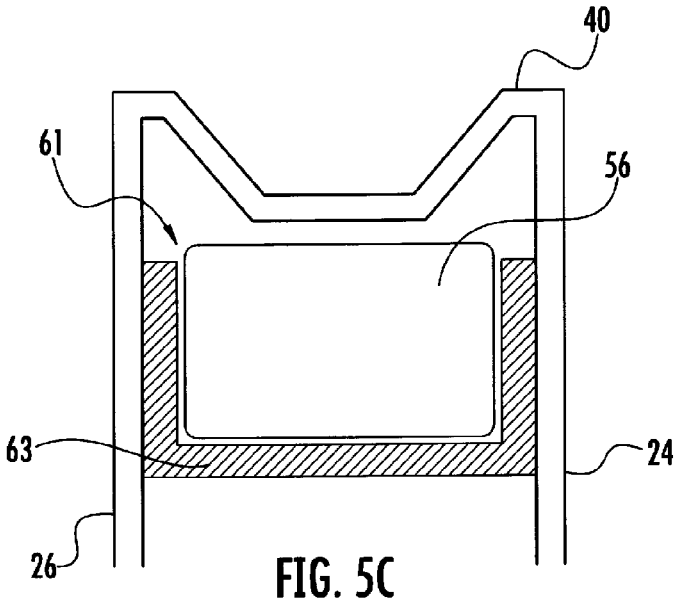
FIG. 5C is a front view of the embodiment of the roof tile crown support show in FIG. 5B.
Figure 6:
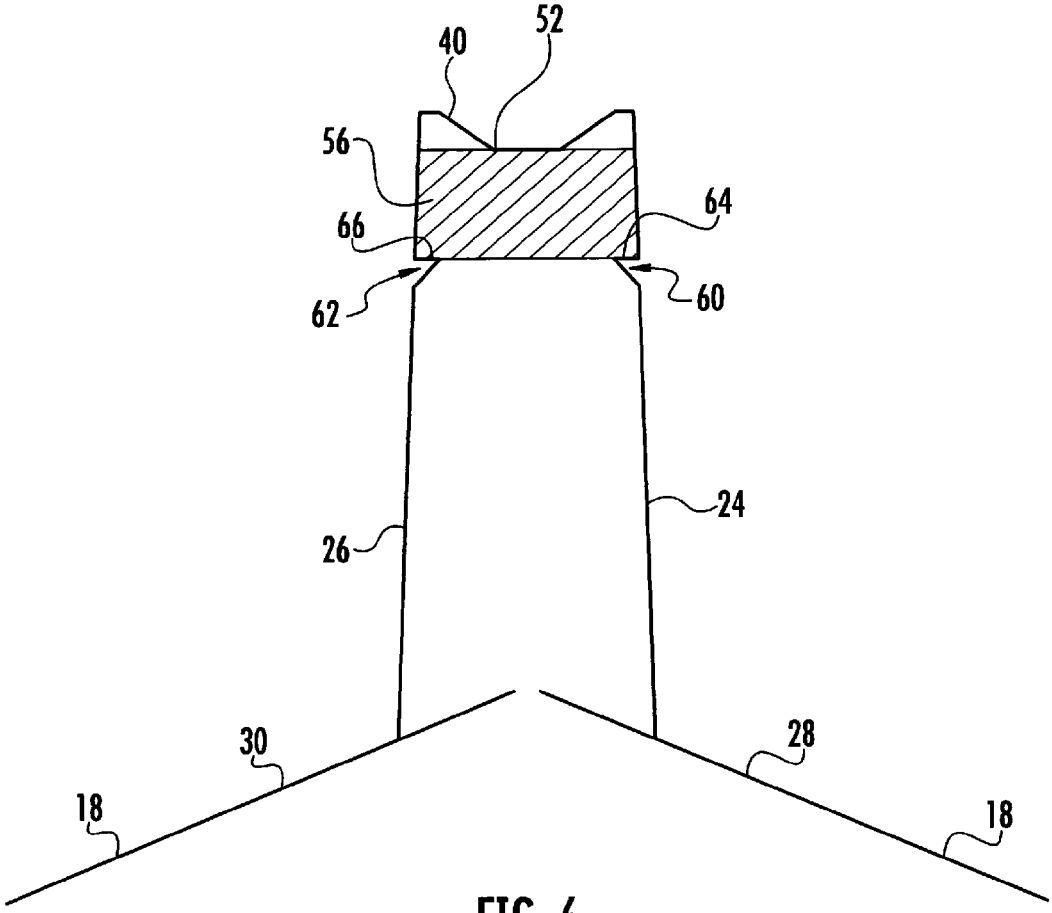
FIG. 6 illustrates an alternative embodiment of the roof tile crown support in accordance with the present invention.
Figure 7:
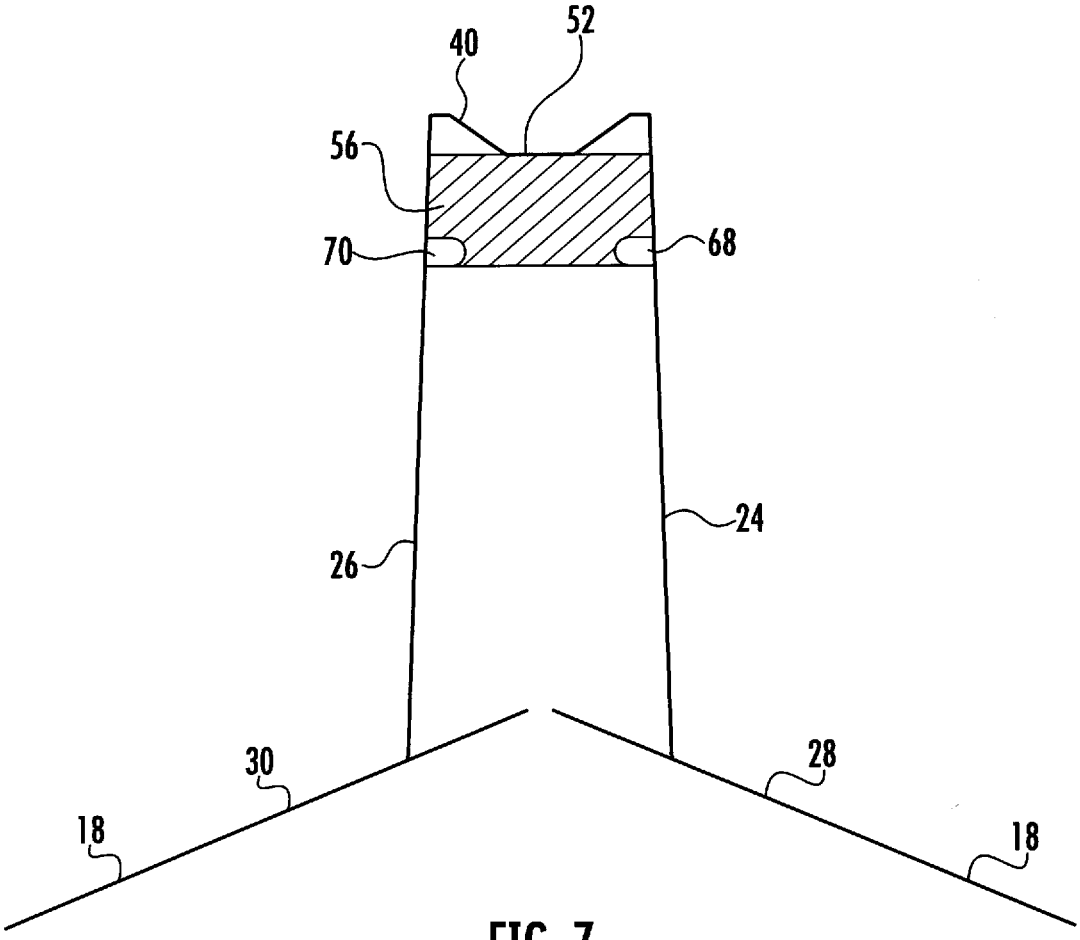
FIG. 7 illustrates an alternative embodiment of the roof tile crown support in accordance with the present invention.

FIGS. 5-7 illustrate alternative mechanisms for securing the insert spacer 56 within the interior area 54. Referring to FIG. 5A, the roof tile crown support 10 is shown having an insert spacer support structure 59, illustrated as a shelf, running the length of the interior area. The insert spacer support structure or saddle 59 may be formed independently of the roof tile crown support 10 and secured to the opposing side walls 24 and 26 using mechanical or other fastening means known to one of skill in the art. Alternatively, the insert spacer support structure 59 may be integrally formed with the roof tile crown support unit. FIGS. 5B and 5C illustrates a support structure 59 formed by cutting portion 61 of side walls 24 and folding it back to define the saddle 63. The saddle 63 runs the length of the roof tile crown support 10 and allows the insert spacer 56 to rest therein and/or to be secured thereto. FIG. 6 illustrates the roof tile crown support 10 containing both side walls 24 and 26 having crimped portions 60 and 62. The crimped portions 60 and extend the length of each side wall and form inwardly directed members or ridges 64 and 66 adapted to support the insert spacer 56 when inserted within the interior area 54 and resting thereupon. FIG. 7 illustrates an alternative mechanism for securing the insert spacer 56 within the interior area 54. In this embodiment, one or more pair of tabs 68 and 70 are use to secure the insert spacer 56. The pair of tabs 68 and 70 can be cut and bent in order to be embedded into the insert spacer 56.

Figure 8A:
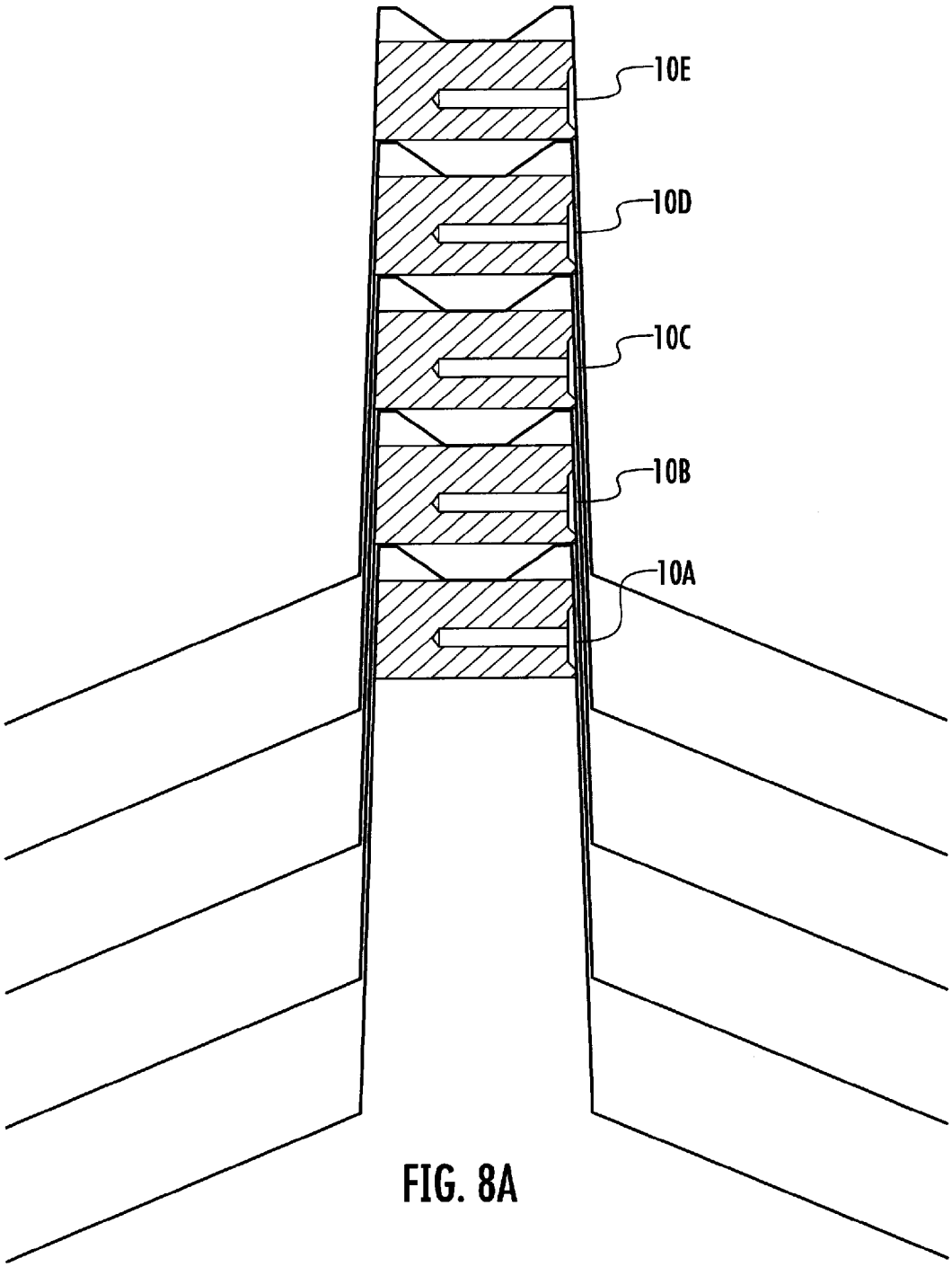
FIG. 8A illustrates a plurality of the roof tile crown supports as illustrated in FIG. 3 in a nested configuration.
Figure 8B:
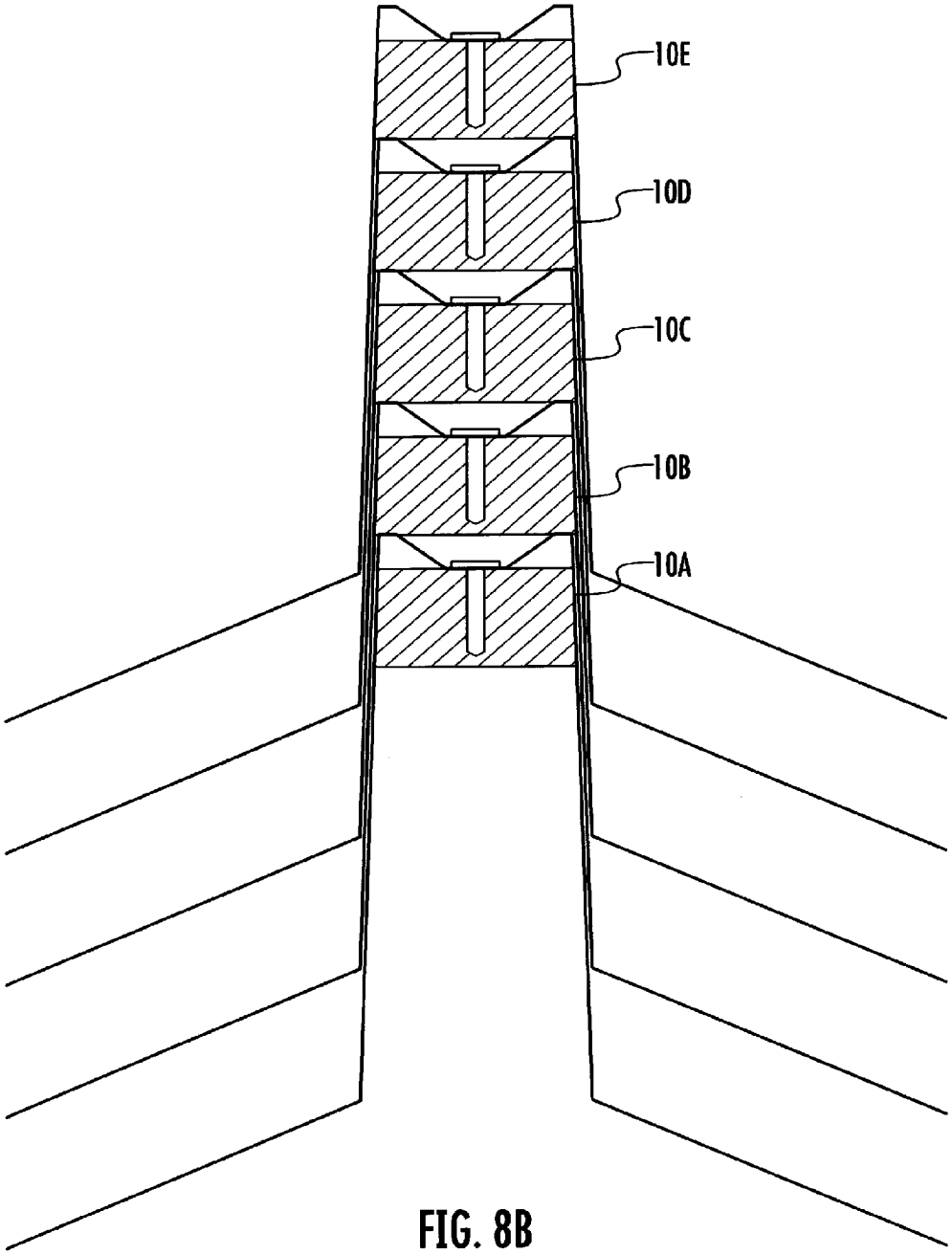
FIG. 8B illustrates a plurality of the roof tile crown supports as illustrated in FIG. 4 in a nested configuration.
Figure 8C:
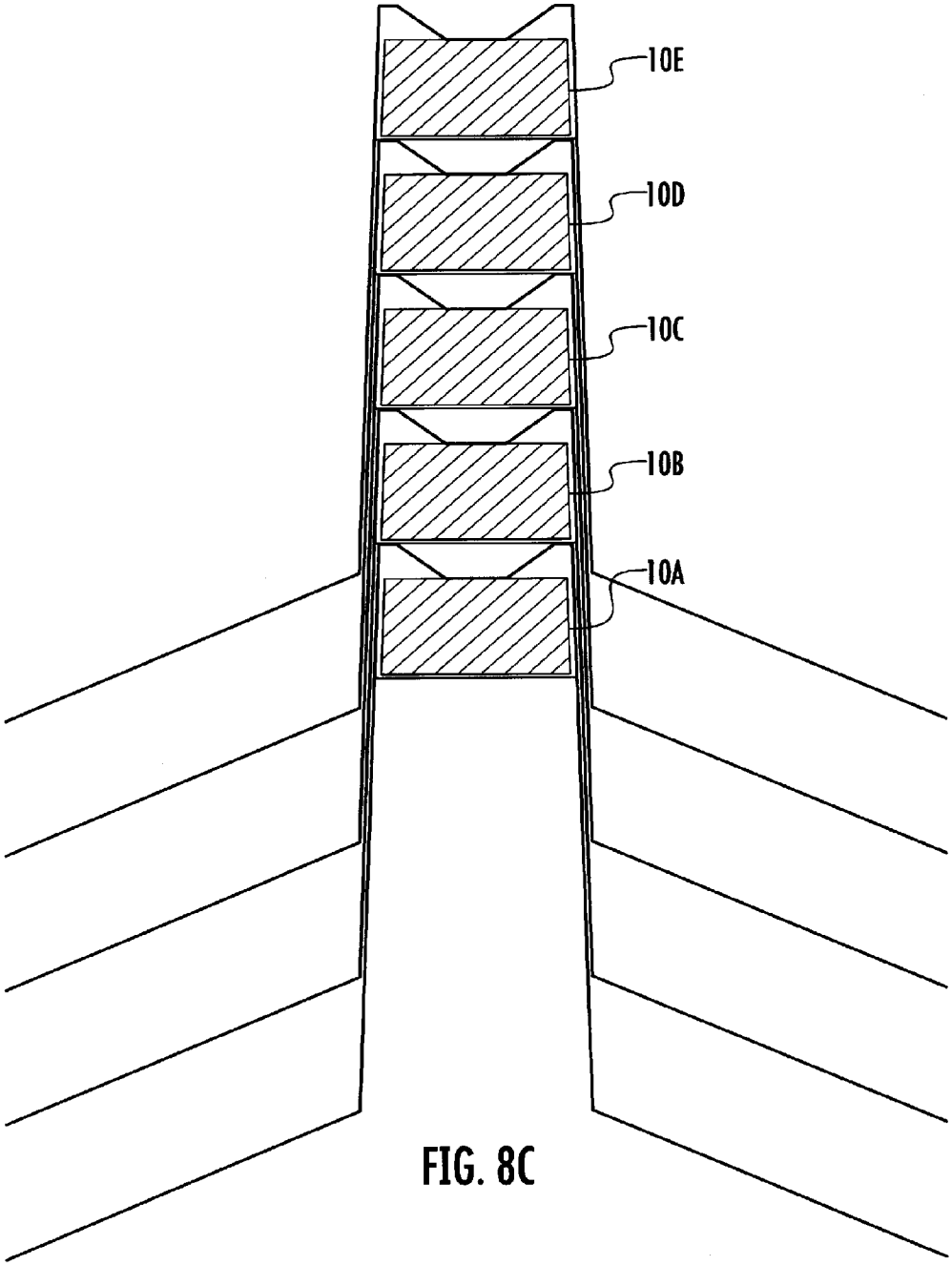
FIG. 8C illustrates a plurality of the roof tile crown supports as illustrated in FIG. 5 in a nested configuration.
Figure 8D:
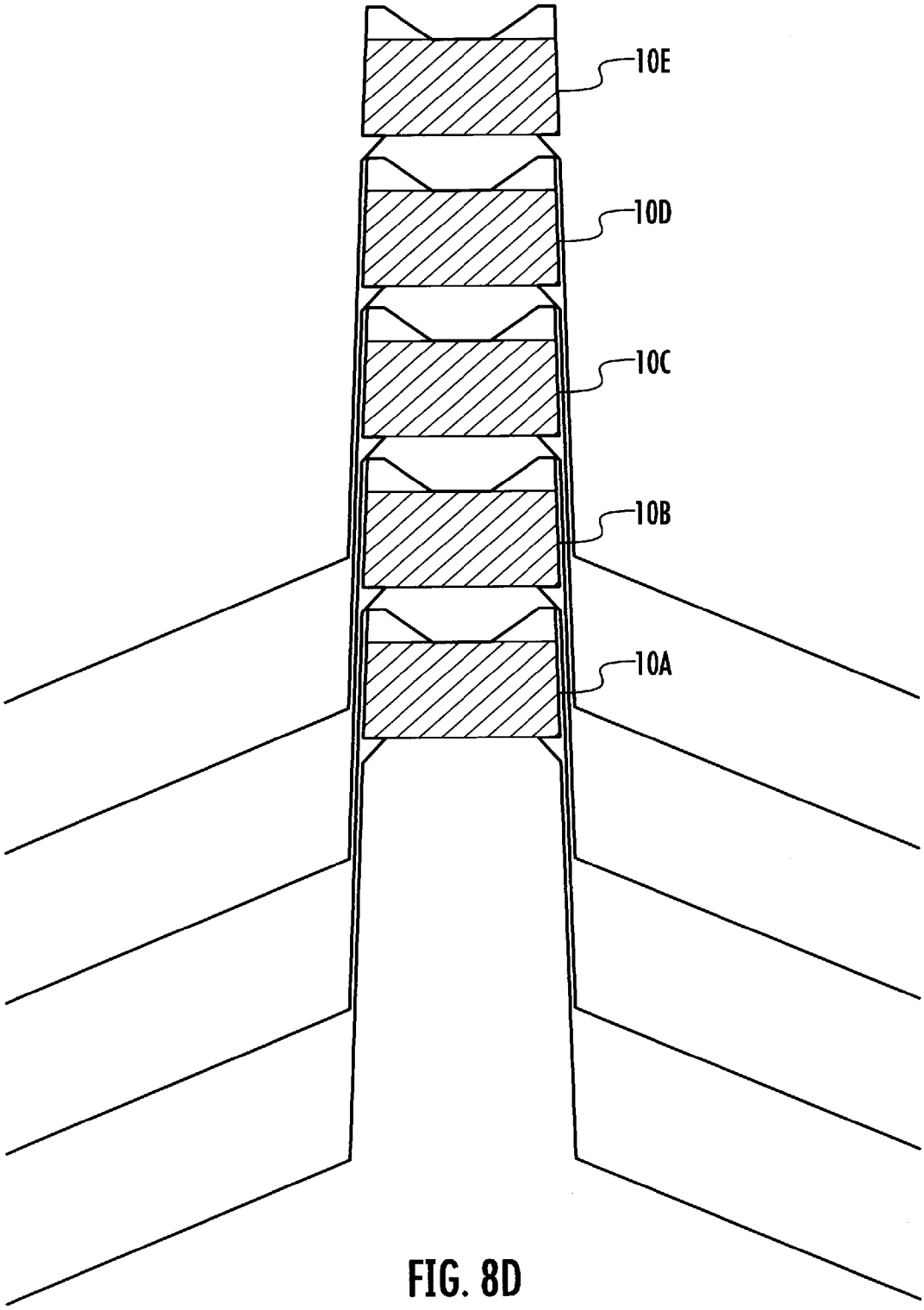
FIG. 8D illustrates a plurality of the roof tile crown supports as illustrated in FIG. 6 in a nested configuration.
Figure 8E:
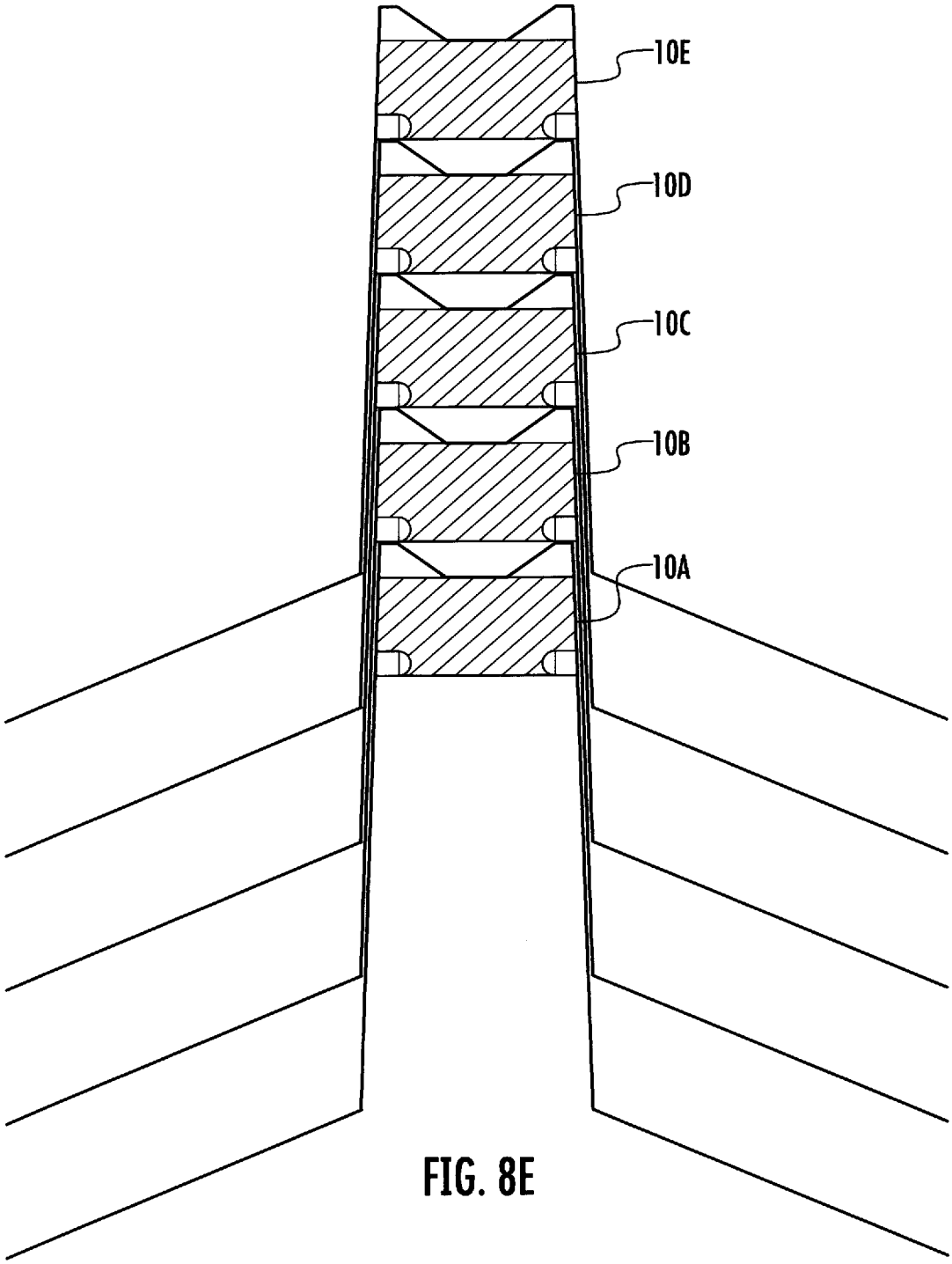
FIG. 8E illustrates a plurality of the roof tile crown supports as illustrated in FIG. 7 in a nested configuration.

The roof tile crown support 10 can be sized to any desired length. Accordingly, each roof tile crown support 10 can be custom made specifically for each roof structure. Alternatively, a plurality of roof tile crown supports 10 can be used to create a desired length. Placing two or more units back to back results in obtaining a desired length without the need to customize the length for each unit. In order to do so, a plurality of the roof tile crown supports must be transported and stored at a job site. The present invention is also adapted to provide ease in transportation and storage. As shown in FIG. 8A, a plurality of roof tile crown supports illustrated in FIG. 2 is shown nested with other like-shaped roof tile crown supports. Accordingly, a first roof tile crown supports 10A is designed so the outer surface of unit contacts the inner surface of the roof tile crown support 10B. In this manner, a portion of the roof tile crown support 10A is secured between the opposing walls of the roof tile crown support 10B. The roof tile crown supports 10C-10E are nested in a similar manner, thereby minimizing possible damage to the units during shipping and reducing the amount of space needed for shipping and/or storage. FIGS. 8B-8E illustrate the exemplary embodiments of the roof tile crown support shown in FIGS. 2-5 arranged in the nested configuration.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A roof tile crown support structure securable to a roofing structure comprising:

a unitary structure comprising an elongated first wall, an elongated second wall, a top wall, and an insert spacer support structure;

said elongated second wall being spaced apart from said elongated first wall and being arranged in a generally parallel orientation to said elongated first wall, whereby a distance between said elongated first wall and said elongated second wall defines an interior region;

said top wall having at least one surface connecting said elongated first wall and said elongated second wall;

an insert spacer having the same length as said unitary structure and positioned within said interior region of said roof tile crown support structure and sized and shaped to extend the length of said roof tile crown support structure; and said insert spacer support structure configured to support and hold said insert spacer at a predetermined position within said interior region of said roof tile crown support structure, said insert spacer support structure comprising at least one first portion extending inwardly towards said interior region and positioned below said top wall, and at least one second portion extending inwardly towards said interior region and positioned below said top wall;

whereby said at least one first portion extending inwardly towards said interior region and said at least one second portion extending inwardly towards said interior region form a saddle for maintaining said insert spacer at a predetermined position.

2. The roof tile crown support structure securable to a roofing structure according to claim 1 wherein said elongated first wall further comprising a leg plate roof securing structure adapted to secure to a first portion of an independent planar structure, said elongated second wall further comprising a leg plate roof securing structure adapted to secure to a second portion of said independent planar structure.

3. The roof tile crown support structure securable to a roofing structure according to claim 2 wherein said first wall leg plate roof securing structure and said second wall leg plate roof securing structure each comprises a planar body arranged at an angle from said elongated first and second walls.

4. The roof tile crown support structure securable to a roofing structure according to claim 2 wherein said first wall leg plate roof securing structure and said second wall leg plate roof securing structure each comprises a planar body secured to an end of said elongated first and second walls, said planar body adapted to be traversable between a first position defined as being in a generally perpendicular relationship with each said elongated first and second walls and a second position being defined as each said planar body arranged at an angle from said elongated first and second walls.

5. The roof tile crown support structure securable to a roofing structure according to claim 1 wherein said top wall comprises a plurality of segmented surfaces, at least one segmented surface forming a bottom surface.

6. The roof tile crown support structure securable to a roofing structure according to claim 1 wherein said unitary structure further includes at least one tab, said at least one tab extending inwardly toward said interior region to support said insert spacer.

7. The roof tile crown support structure securable to a roofing structure according to claim 1 wherein said elongated first wall and said elongated second wall each comprise a crimped portion.

8. The roof tile crown support structure securable to a roofing structure according to claim 1 wherein said unitary structure contains at least one cut out portion which is folded inwardly towards said interior region to form said saddle.

9. The roof tile crown support structure securable to a roofing structure according to claim 8 wherein said unitary structure includes at least one second cut out portion, said at least one second cut out portion folded inwardly towards said interior region to form at least one second saddle, said at least one second saddle positioned at a distance from said saddle.

10. The roof tile crown support structure securable to a roofing structure according to claim 1 wherein said unitary structure is configured to nest with a like-shaped unitary structure.

11. A roof tile crown support structure securable to a roofing structure comprising:

a unitary structure forming a single unit comprising an elongated first wall, an elongated second wall, a top wall, and an insert spacer support structure;

said elongated first wall having a planar body secured to an end;

said elongated second wall comprising a planar-body secured to an end, said elongated second wall being spaced apart from said elongated first wall and being arranged in a generally parallel orientation to said elongated first wall, whereby a distance between said elongated first wall and said elongated second wall defines an interior region;

an insert spacer having the same length as said unitary structure and positioned within said interior region of said roof tile crown support structure;

said insert spacer support structure configured to maintain said insert spacer below said top wall and within said interior region of said roof tile crown support structure, said insert spacer support structure comprising at least one first portion extending inwardly towards said interior region and at least one second portion extending inwardly towards said interior region.

12. The roof tile crown support structure securable to a roofing structure according to claim 11 wherein said insert spacer support structure is formed by a crimped portion within said elongated first wall and said elongated second wall, each said crimped portion forming inwardly directed ridges adapted to support said insert spacer.

13. The roof tile crown support structure securable to a roofing structure according to claim 11 wherein said unitary structure contains at least one cut out portion which is folded inwardly to form a first saddle positioned below said top wall.

14. The roof tile crown support structure securable to a roofing structure according to claim 13 wherein said unitary structure includes at least one second cut out portion, said at least one second cut out portion folded inwardly to form at least one second saddle positioned below said top wall, said at least one second saddle positioned at a distance from said first saddle.

15. The roof tile crown support structure securable to a roofing structure according to claim 11 wherein said elongated first wall planar body is arranged at an angle from said elongated first wall and said elongated second wall planar body is arranged at an angle from said elongated second wall.

16. The roof tile crown support structure securable to a roofing structure according to claim 11 wherein said unitary structure is configured to nest with a like-shaped unitary structure.

* * * * *